United States Patent [19]

Niedermeyer

[11] Patent Number: 4,461,614

[45] Date of Patent: Jul. 24, 1984

[54] THROUGH FLOW SUMP PUMP

[76] Inventor: Karl O. Niedermeyer, 17W068 North St., Bensenville, Ill. 60106

[21] Appl. No.: 368,860

[22] Filed: Apr. 15, 1982

[51] Int. Cl.[3] ..... F04B 35/04; F04B 39/00

[52] U.S. Cl. ..... 417/424; 415/121 G

[58] Field of Search ..... 417/38, 44, 424; 415/121 G, 111, 175, 200, 168; 166/105.1

[56] References Cited

U.S. PATENT DOCUMENTS

| | | | |
|---|---|---|---|
| 220,085 | 9/1879 | Milford | 166/105.1 |
| 2,406,947 | 9/1946 | Harlamoff | 415/111 |
| 2,918,016 | 12/1959 | Olson | 417/38 |
| 3,191,364 | 6/1965 | Syluan | 415/168 |
| 3,776,660 | 12/1973 | Anderson | 415/200 |
| 3,999,890 | 12/1976 | Niedermeyer | 417/36 |
| 4,230,440 | 10/1980 | Niedermeyer | 417/424 |
| 4,406,594 | 9/1983 | Smaby | 417/372 |

*Primary Examiner*—William L. Freeh

*Attorney, Agent, or Firm*—Lee, Smith & Zickert

[57] ABSTRACT

An improved sump pump apparatus of submersible nature of the type in which a pump impeller is located above an intake opening for drawing sump water through the intake opening and expelling the same through a pump discharge connection. The pump impeller is immediately adjacent the top of the intake opening, the top of the intake opening including a lubricating surface and the impeller being positioned as closely as possible to the top. A debris trap is situated within the pump beneath the intake opening to capture small debris, such as sand and stones, which are drawn into the pump by the impeller. Air relief means is located the discharge outlet for the sump pump in particular situations.

13 Claims, 9 Drawing Figures

THROUGH FLOW SUMP PUMP

BACKGROUND OF THE INVENTION

This invention relates to sump pump apparatus and in particular to an improved sump pump of increased pumping capacity and high reliability.

As explained in my former U.S. Pat. No. 4,177,021, which is incorporated herein by reference, sump pumps of the nature of the present invention are primarily utilized as emergency sump pumps, although features thereof can be utilized in pumps for other purposes. It is important that an emergency sump pump be reliable and, since the emergency sump pump normally functions only under extraordinary conditions, that the sump pump be of an adequate capacity to handle large quantities of water which accumulate in a sump during heavy storms. The pumping rate of the sump pump should be equal to or greater than the rate at which the storm water accumulates in the sump to prevent water overflow and the consequential damage which might thereby be caused.

In prior sump pump apparatus, such as that set forth in referenced U.S. Pat. No. 4,177,021, the pump impeller is situated in close proximity to the pump intake opening at the top of an intake conduit. However, the impeller must be separated a short distance from the intake conduit to avoid frictional engagement of the impeller and intake conduit. Any gap between the conduit and impeller reduces the optimal pumping capacity of the sump pump.

Prior art sump pumps include a switch of some nature to actuate the sump pump when necessary to withdraw storm water from the sump. Such switches may be activated by a float within the sump or may be incorporated into a micro switch which is activated by a particular water pressure within the sump. However, floats tend to become encrusted with contaminants, limiting their reliability, while micro switches can also become encrusted or become jammed by contaminants, such as sand or small stones. In any case, the reliability of the sump pump is compromised if accurate cycling cannot be assured, particularly if the pump is an emergency sump pump.

SUMMARY OF THE INVENTION

The present invention improves upon prior art sump pump apparatus of the type including a pump having an outer shell, a motor located in the shell, the motor including a waterproof housing and having a motor shaft with a portion of the shaft extending externally of the housing. A pump impeller is affixed to the external shaft portion and is proximate a pump intake opening in an intake conduit which extends through the sump pump shell. A discharge connection to the shell provides for discharge of pump water from the shell.

In accordance with the invention, the pump impeller bears lightly against the top of the intake opening. The top of the opening includes a lubricating surface against which the impeller bears so that excessive frictional heating is avoided. A debris trap is located within the shell and is situated about the intake conduit and beneath the intake opening to capture small pebbles and other grit, such as sand, which may be sucked into the intake conduit by the impeller. Thus, pump failure by clogging of the impeller by such debris is avoided.

The intake opening includes a truncated conical opening reducer. The top of the reducer constitutes the lubricating surface against which the impeller bears. The reducer may be formed of a material having self-lubricating qualities, such as carbon or graphite based materials.

The invention includes an air tube for transmitting water pressure within the sump to a pressure detector. The base of the shell of the pump includes a container having an open bottom and which is located in the base of the shell for trapping air therewithin when the shell is immersed in water. The air tube extends into the container to detect the pressure therein. The container is shaped to snugly fit within the shell to form the bottom of the shell.

The intake conduit passes through an aperture in the top of the container. An integral annular collar is included about the aperture surrounding the intake conduit and has at least one vertical slot therein. A strap is positioned surrounding the collar at the slot and can be tightened about the collar to clamp the collar to the intake conduit.

In order to prevent large debris from being sucked up the intake conduit, a debris screen extends beneath the intake conduit and is friction-fitted into the shell. The screen is perforated so that sump water can freely flow therethrough, but large debris cannot.

In accordance with one embodiment of the invention, the sump pump apparatus is immersible within the sump. In another embodiment of the invention, the sump pump is not submersed and can be situated above a floor opening with the intake conduit extending through the opening to the depth of the cavity beneath the opening.

BRIEF DESCRIPTION OF THE DRAWINGS

The invention is described in greater detail in the following description of the preferred embodiments, taken in conjunction with the drawings, in which.

DESCRIPTION OF THE PREFERRED EMBODIMENTS

Figure 1:
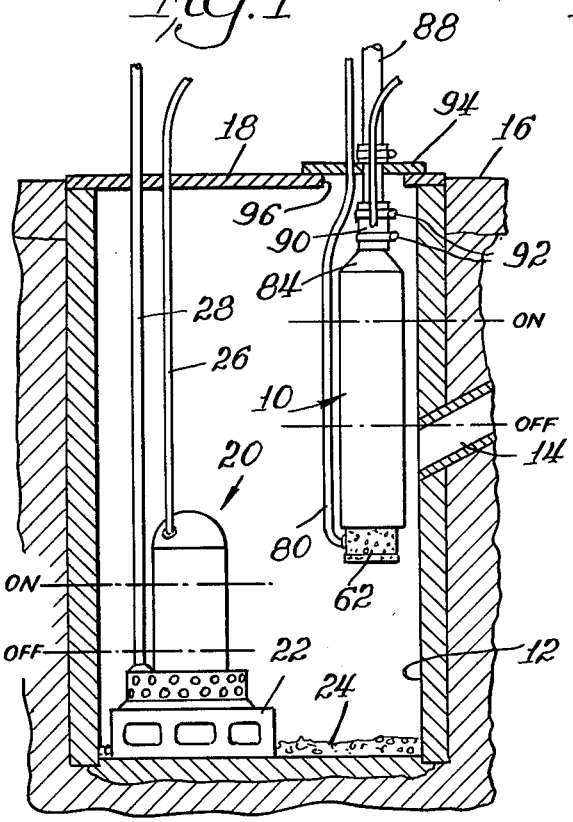
FIG. 1 is an elevational view of the invention positioned within a sump.

In FIG. 1, a sump pump 10 according to the invention is shown within a sump 12 having an inlet 14. The sump 12 typically is a pit in a basement floor 16, the sump 12 itself being covered by a lid 18 as shown.

Since the sump pump 10 is normally utilized in an emergency situation when a power outage occurs or when the flow rate into the sump 12 cannot be accommodated by a conventional sump pump 20, the sump pump 10 preferably is situated nearer the top of the sump 12 so that the sump pump 10 is not bathed by the normal fluctuations of the water level within the sump 12 as controlled by the sump pump 20. However, if the sump 12 is of insufficient depth, the sump pump can be subjected to the bathing experienced by the submersible sump pump 20, as described in greater detail below in connection with FIG. 6.

As shown in FIG. 1, the sump pump 20 is situated on a block 22 above the floor of the sump 12 to avoid ingestion of debris 24 which typically accumulates within the sump 12. As is conventional, the sump pump 20 includes a power cord 26 and a discharge conduit 28 through which sump water is removed from the sump 12 and disposed of in a usual fashion.

Figure 2:
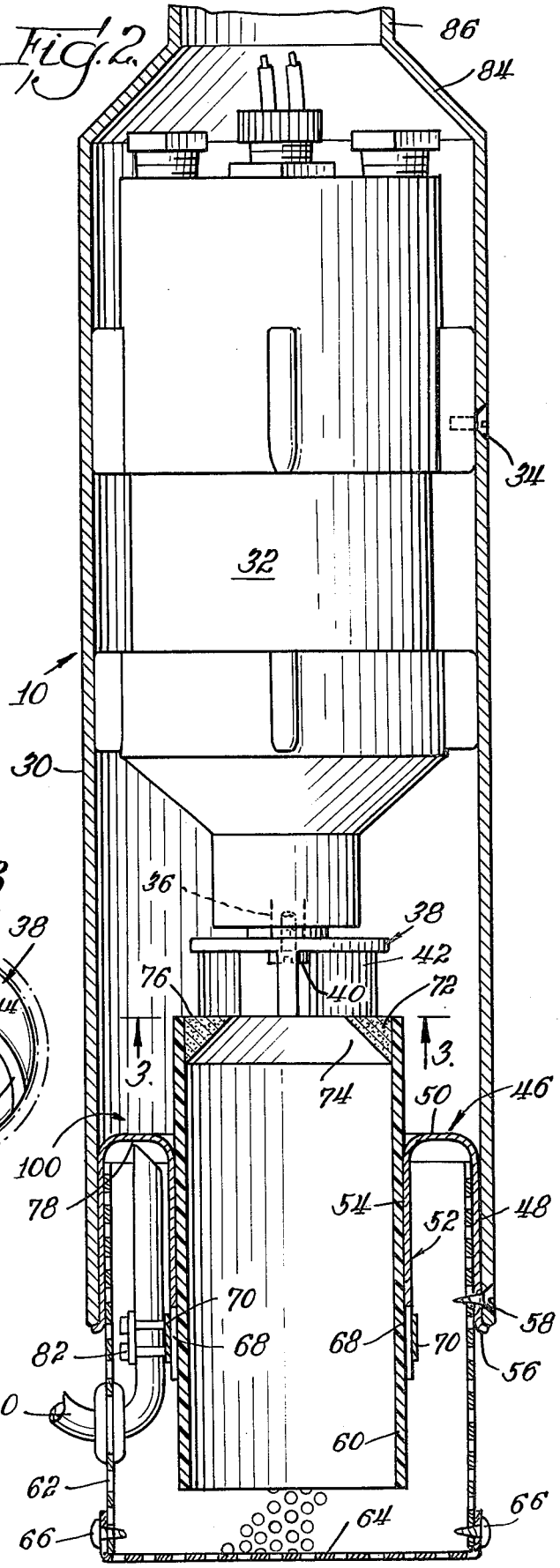
FIG. 2 is an enlarged, longitudinal cross-sectional view of the pump of the invention.

The sump pump 10 of the invention is shown in cross section in FIG. 2. It includes an outer, hollow shell 30 and a motor 32, situated within a waterproof housing, mounted within the shell 30 and held in place by a recessed set screw 34. The motor 32 is described in referenced U.S. Pat. No. 4,177,021, from which a more detailed description of the motor 32 may be obtained.

The motor 32 has a driven shaft 36. An impeller 38 is attached to the shaft 36 by a screw 40, and includes a series of curved vanes 42. Each vane 42 has a tip 44 shaped to scoop a maximum amount of water as the impeller 38 is rotated by the motor 32.

The bottom of the shell 30 is capped by a container 46 having an open bottom and being shaped to fit snugly within the shell 30. The container 46 has a cylindrical side wall 48, an integral, sealed top 50, and an integral annular collar 52 forming an internal aperture 54 in the container 46. The bottom of the side wall 48 terminates in an outwardly-directed flange 56 of greater diameter than the internal diameter of the shell 30 such that the flange 56 forms a stop when the container 46 is inserted within the shell 30. A recessed set screw 58 is used to secure the container 46 in place within the shell 30, penetrating the container 46 as shown. The screw 58 is located as low as possible in the shell 30 and container 46 to avoid an air leak in the container 46.

An intake conduit 60 extends through the aperture 54. The collar 52 is closely fitted about the intake conduit 60 to form a substantial seal therebetween, but normally the fit between the conduit 60 and collar 52 permits relative vertical adjustment of the conduit 60 within the aperture 54.

The conduit 60 extends downwardly beneath the shell 30. The conduit 60 is open into a debris screen 62 which is friction-fitted into the container 46. The diameter of the screen 62 is only slightly less than the diameter of the cylindrical side wall 48 so that the screen 62 is tightly held. As shown, the screw 58 may penetrate the screen 62 to hold the screen in place. The screen 62 is perforated as shown to permit water to freely enter the screen 62, but to effectively block ingestion of debris larger than the holes in the screen 62. The screen 62 may include a separable bottom 64 held in place by a series of screws 66.

The collar 52 includes a pair of vertical slots 68 extending a short distance therein. A strap 70 extends about the outer periphery of the collar 52 at the elevation of the slots 68. The strap 70 includes a conventional adjustment (not illustrated) for tightening the strap about the collar 52. This, in turn, due to the slots 68, clamps the collar 52 to the intake conduit 60 to hold the conduit 60 firmly in place.

The top of the conduit 60 terminates at the plane of the bottom of the vanes 42. The top of the conduit 60 forms an intake opening into the interior of the shell 30. As shown, an annular reducer 72 is lodged in the top of the conduit 60 and butts directly against the impeller 38. The reducer 72 has a truncated conical opening 74 opened to the impeller 38 through which water is drawn into the conduit 60 by the impeller 38 and discharged into the interior of the shell 30. The top surface 76 of the reducer 72 forms a lubricating surface and the impeller 38 is positioned as closely as possible to the top surface 76 without causing frictional interference. Preferably, the reducer 72 is composed of a self-lubricating material containing ingredients such as carbon or graphite which lubricate the interface between the vanes 42 of the impeller 38 and the top surface 76 of the reducer 72.

The intake conduit 60 may be formed of conventional metal or plastic materials. The internal diameter of the conduit 60 is larger than the diameter of the sweep of the vanes 42 so that the vanes bear solely against the lubricating top surface 76 of the reducer 72. Since the position of the intake conduit 60 is adjustable by means of the strap 70, the conduit 60 may be positioned so that the top surface 76 abuts the bottoms of the vanes 42. Furthermore, should the top surface 76 wear with age, the position of the conduit 60 can be readjusted as needed to assure a close tolerance between the vanes 42 and the top surface 76.

The interior 78 of the container 46 is sealed, forming a trap for air therewithin when the shell 30 is immersed in water. Air pressure within the container interior 78 is detected by a hollow air tube 80, one end of which extends through the screen 62 into the interior 78 of the container 46 and the other end of which extends from the sump to a suitable conventional detector (not illustrated) which senses the air pressure within the tube 80 and, if a sufficiently high air pressure is registered indicative of the sump pump 10 being immersed in water, actuates control circuitry (not illustrated) which serves to activate the motor 32. As shown, a clamp 82 attached to the strap 70 is used to properly position the tube 80 within the container interior 78.

The shell 30 is closed with a reducer 84 which is a sealed extension of the shell 30. The reducer 84 includes a neck 86 which forms a discharge connection for the sump pump 10.

As shown in FIG. 1, the sump pump 10 is situated to discharge into a outlet conduit 88. The reducer 84 joins the outlet conduit 88 in a sleeve 90. Preferably, the sleeve 90 is of an elastomeric material and is secured to the reducer 84 and outlet conduit 88 by a pair of adjustable clamps 92. The flexibility of the sleeve 90 substantially dampens any vibration of the sump pump 10 so that any such vibration is not transmitted to the outlet conduit 88.

Figure 3:
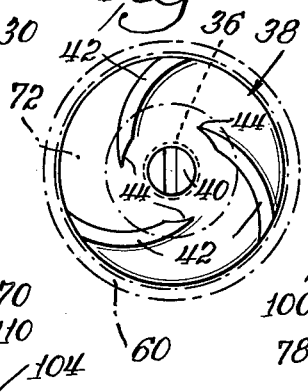
FIG. 3 is a cross-section taken along lines 3—3 of FIG. 2.

In the embodiment of the invention shown in FIGS. 1 through 3, the outlet conduit 88 is the sole support for the sump pump 10. As shown in FIG. 1, a seal plate 94 rests on the lid 18 above an aperture 96 therein. A second sleeve 98 is clamped to the outlet conduit 88 and rests on the top of the seal plate 94. The sleeve 98 therefore supports the sump pump 10 on the lid 18 through the plate 94, while the plate 94 seals the aperture 96 and thus seals the sump 12. Such an arrangement is particularly advantageous when the lid 18 is quite large or heavy. The entire pump assembly can be inserted through the aperture 96 without removal of the lid 18. Alternatively, other means of suspending the sump pump 10 within the sump 12 may be employed such as those disclosed in referenced U.S. Pat. No. 4,177,021.

As shown in FIG. 2, the top of the conduit 60 extends well above the top 50 of the container 46, forming an annular debris trap 100 within the shell 30. The debris trap 100 catches any heavy and potentially abrasize materials, such as sand and small stones, which are sucked into the conduit 60 by the impeller 38. Since the cross-sectional area of the shell 30 is substantially greater than the inlet formed by the conical opening 74, a venturi effect is created and any such debris sucked into the shell 30 will settle within the debris trap 100, thus substantially avoiding clogging of the impeller 38. Should the amount of debris in the debris trap 100 ever accumulate to the extent of filling the debris trap 100, the container 46 can easily be removed from the shell 30 by loosening of the set screw 58, and the sump pump 10 can be cleaned of any such debris.

Figure 4:
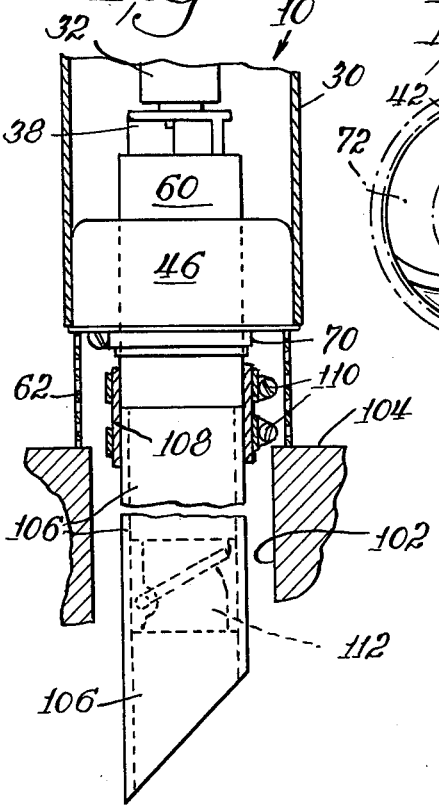
FIG. 4 is an elevational cross-sectional view, with portions broken away, of a second embodiment of the invention.

In the embodiment 10' of the sump pump shown in FIG. 4, the majority of the components of the invention as described above remain unchanged. Therefore, such components retain the same reference numerals and a further description thereof is omitted.

In this embodiment, the sump pump 10' is normally not immersed in water and is located above a drain opening 102 in a basement floor 104. The bottom 64 of the screen 62 is removed, and the entire weight of the sump pump 10' may be borne by the screen 62 upon the floor 104. In this instance, a draw pipe 106 extends from the intake conduit 60 through the drain opening 102, and is of sufficient depth to reach as far as desired into the drain opening 102. A coupling 108 having clamps 110 is used to join the draw pipe 106 to the conduit 60. If necessary, a check valve 112 can be installed within the draw pipe 106.

Figure 5:
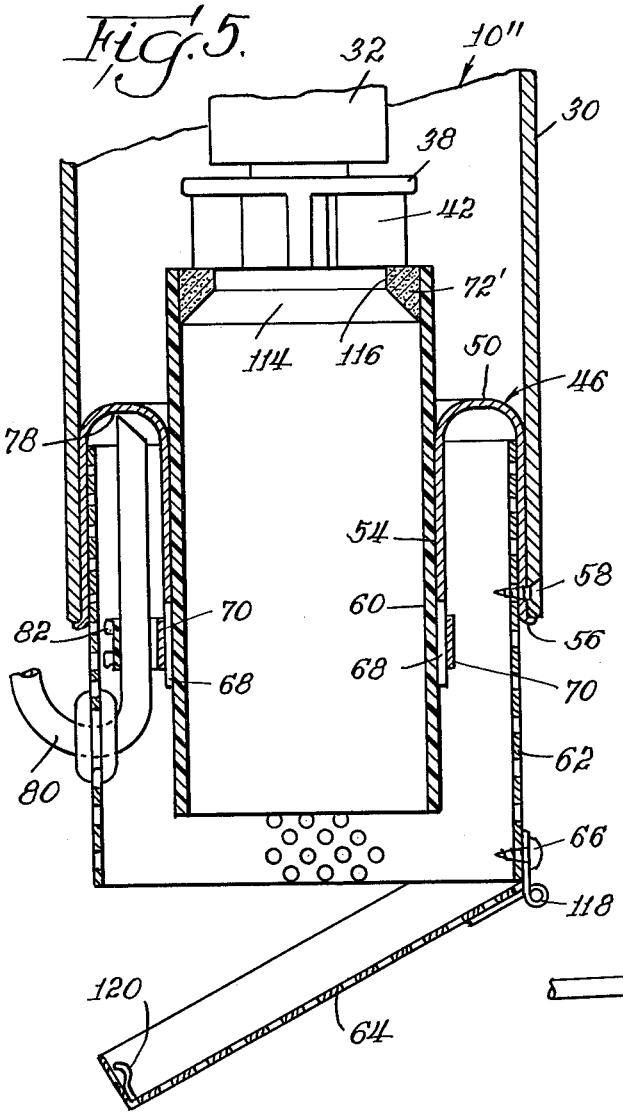
FIG. 5 is an enlarged, partial longitudinal cross-sectional view of another embodiment of the pump of the invention.

FIG. 5 illustrates an alternative form of a sump pump 10" according to the invention. The majority of the components of the sump pump 10" of FIG. 5 are identical to those shown and described above, and therefore carry the same reference numerals. A detailed description of those elements will not be repeated.

Similar to the embodiment of FIG. 2, the top of the conduit of FIG. 5 terminates at the plane of the bottom of the vanes 42 and an annular reducer 72' is lodged in the top of the conduit 60 and butts directly against the impeller 38. The reducer 72' has a conical opening portion 114 and a cylindrical opening portion 116 extending from the conical portion 114. As a result, the orifice formed by the cylindrical opening portion 116 is larger than the similar orifice opening formed by the conical opening 74 of the embodiment of FIG. 2. Thus, it is seen that the orifice opening to the impeller 36 can be varied in size, with a smaller opening resulting in lesser capacity of the sump pump 10", while a larger opening allows a higher water volume to be removed from the sump 12.

Also in FIG. 5, the screen bottom 64 is attached to the screen 62 by means of a hinge 118. A clip 120 at the opposite edge of the screen bottom 64 from the hinge 118 is used to keep the bottom 64 normally closed about the base of the screen 62. If the screen 62 becomes clogged, the bottom 64 can be released automatically if the prime of the pump 10" fails or the pump shuts off. Unremoved sump water returning through the intake conduit 60 bears against the bottom 64 which releases at the clip 120 and pivots about the hinge 118. The bottom 64 therefore automatically opens, when clogged, whenever the prime of the pump fails or the pump terminates a normal cycle.

At times, the sump 12 can have a large quantity of floating debris. In such a situation, the screen bottom 64 can be removed entirely, or, as shown in FIG. 5, can be maintained in a downwardly released position.

Figure 6:
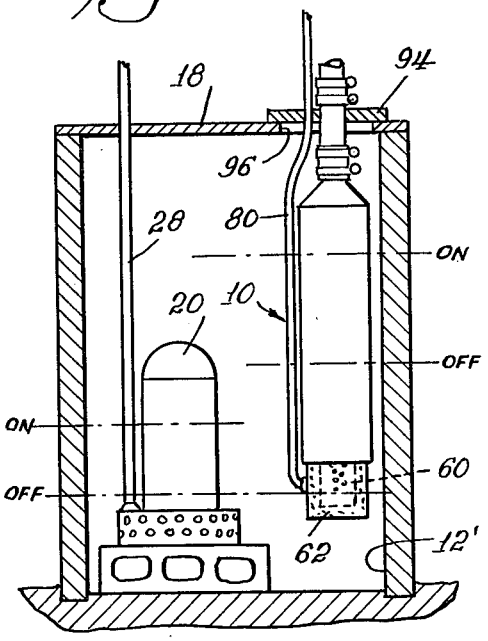
FIG. 6 is an elevational view of the invention positioned within a sump that is shallower than that of FIG. 1.

FIG. 6 illustrates the invention when the sump pump 10 is located in a sump 12' which is shallower than the sump 12 of FIG. 1. As shown, the normal cycle of the sump pump 20 is such that the screen 62 and intake conduit 60 of the sump pump 10 are bathed during cycling of the sump pump 20. In such an instance, and as shown in FIG. 6, the intake conduit 60 of the sump pump 10 is positioned such that the conduit 60 always extends below the lowest water level in the sump 12', dictated by the off location of the sump pump 20. Thus, the intake conduit 60 is always below any floating debris which may be accumulated within the sump 12'.

Figure 7:
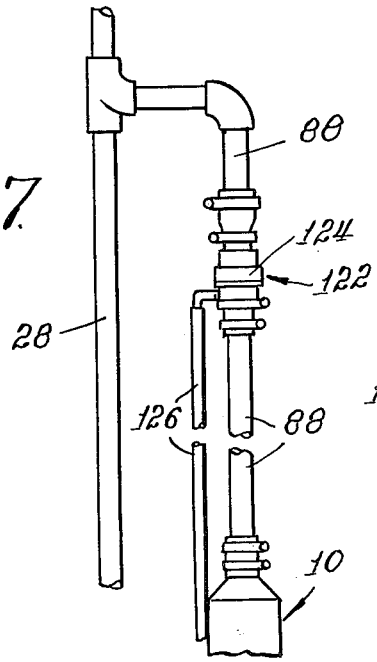
FIG. 7 is an elevational view, with parts broken away, of a sump pump and check valve having a vent.

FIG. 7 illustrates a situation in which the outlet conduit 88 of the sump pump 10 is joined downstream with the discharged conduit 28 of the sump pump 20. In such a situation, a vented check valve 122 is installed in the outlet conduit 88. The check valve 122 includes a conventional two way valve 124 and a vent tube 126 leading from the bottom of the valve 124 and returning to the sump 12. The vent tube 126 is positioned such that after cycling of the sump pump 10 and with the valve 124 closed by the weight of water in the outlet conduit 88 above the valve 124, the tube 126 allows air to enter the portion of the outlet conduit 88 beneath the valve 124 and therefore purge that portion of the outlet conduit 88 of water, the water being expelled downwardly into the sump pump 10 in the reverse direction from that when the sump pump 19 is operated. Importantly, the tube 126 also provides an air bleed for the pump 10 so that the pump 10 can be primed before the "on" cycle.

Figure 8:
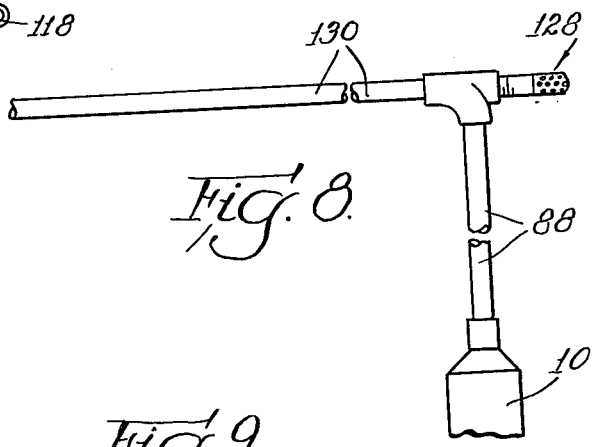
FIG. 8 is an elevational view, with parts broken away, of a sump pump having a pneumatic air break in the discharge.
Figure 9:
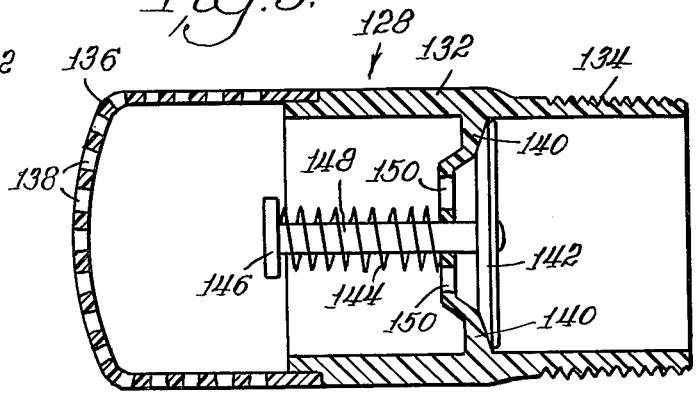
FIG. 9 is an enlarged, cross-sectional view of the pneumatic air break of FIG. 8.

FIGS. 8 and 9 illustrate an air break 128 for use in connection with a sump pump 10 having a discharge conduit 88 having a long, horizontal discharge conduit 130. After cycling of the sump pump 10, the air break 128 permits air to enter the conduits 130 and 88 to purge water remaining therein. Also, as is typical, if the conduit 130 extends outside of a building, the air break 128 breaks any syphoning of water back into the sump 12 or 12' should the conduit 130 or any extension lead into a pool of water.

As shown in FIG. 9, the air break 128 includes a cylindrical body 132 having male threads 134 at one end for union with other pipe elements. A screen 136 is affixed to the other end of the body 132 and includes a series of apertures 138 to allow air to freely pass therethrough. An annular valve seal 140 is formed in the interior of the body 132, as shown. A valve member 142 is normally urged against the valve seat 140 by means of a spring 144 under compression between the head 146 of a stem 148 extending from the valve member 142 and a support 150 extending radially inwardly from the valve seat 140, as shown. The support 150 includes a plurality of holes 150 in order to allow air to pass freely therethrough.

Normally, as indicated above, the spring 144 maintains the valve 142 closed against the valve seat 140. Therefore, during the "on" cycle of the sump pump 10, water is discharged through the discharge conduit 130 and will bear against the valve member 142 to keep it closed against the seat 140. After the sump pump cycles, suction within the conduits 88 and 130 overcomes the compression strength of the spring 144 and allows air to enter the air break 128 between the valve member 142 and the valve seat 140. When the suction within the conduits 88 and 130 diminishes sufficiently, the compression strength of the spring 144 closes the valve member 142 against the valve seat 140. Therefore, by proper selection of the compression strength of the spring 144, the air break 128 can assure that any water remaining in the conduits 88 and 130 is purged after the "on" cycle of the sump pump 10.

Various changes may be made to the invention without departing from the spirit thereof or scope of the following claims.

What is claimed is:

1. In a sump pump apparatus including a pump having an outer shell, a motor located in the shell, the motor including a waterproof housing and having a motor shaft with a portion of the shaft extending externally of said housing, a pump impeller affixed to the external shaft portion, a pump intake opening in an intake conduit which extends through the shell, the intake opening being proximate the pump impeller, and a pump discharge connection, the improvement comprising a. said pump impeller being immediately adjacent the top of said intake opening, the top of said intake opening including a lubricating surface for the interface of said impeller and the top of said intake opening, b. a debris trap within said shell comprising an annular chamber surrounding said intake conduit and extending beneath said intake opening, and c. said shell having a bottom with an aperture shaped for through passage of said intake conduit, and including an annular collar about said aperture surrounding said intake conduit, and further including means for releasably securing said collar to said intake conduit for adjusting the position of said intake conduit relative to said impeller.

2. A sump pump apparatus according to claim 1 in which said intake opening includes a truncated conical opening reducer, the top of said reducer constituting said lubricating surface.

3. A sump pump apparatus according to claim 1 in which said releasable securing means comprises at least one vertical slot in said collar and a strap surrounding said collar at said slot, said strap having an adjustment for tightening said strap about said collar to clamp said collar to said intake conduit.

4. A sump pump apparatus according to claim 1 including a vented check valve proximate said discharge connection.

5. A sump pump apparatus according to claim 1 including an extension for said intake conduit such that said extension is immersible in water without the necessity of any other portion of the sump pump apparatus being immersible in water.

6. A sump pump apparatus according to claim 1 including a discharge conduit attached to said discharge connection, and including an air break in said discharge conduit.

7. A sump pump apparatus according to claim 6 in which said air break includes a valve having a normally closed valve member, and including means maintaining said valve member in a normally closed position.

8. A sump pump apparatus according to claim 7 in which said valve member includes one side communicating with the atmosphere and another side communicating with said discharge conduit, and said maintaining means comprises a spring urging said valve member closed against a seat to prevent communication of the atmosphere with said discharge conduit.

9. In a sump pump apparatus including a pump having an outer shell, a motor located in the shell, the motor including a waterproof housing and having a motor shaft with a portion of the shaft extending externally of said housing, a pump impeller affixed to the external shaft portion, a pump intake opening in an intake conduit which extends through the shell, the intake opening being proximate the pump impeller, and a pump discharge connection, the improvement comprising a. said pump impeller being immediately adjacent the top of said intake opening, the top of said intake including a lubricating surface for the interface of said impeller and the top of said intake opening, b. a debris trap within said shell comprising an annular chamber surrounding said intake conduit and extending beneath said intake opening, and c. a debris screen, said screen extending beneath said intake conduit and being friction-fitted into said shell, and having a hinged bottom.

10. A sump pump apparatus according to claim 9 including means for automatically releasing said hinged bottom.

11. A sump pump apparatus according to claim 9 including an air tube for transmitting pressure to a pressure detector, and including means in the base of said shell for trapping air therewithin when said shell is immersed in water, said air tube extending into said trapping means to detect the pressure therein.

12. A sump pump apparatus according to claim 11 in which said trapping means comprises a container having an open bottom and being shaped to fit snugly within said shell to form a bottom thereof, said container having a sealed top and having an aperture in said top shaped for through passage of said intake conduit.

13. a sump pump apparatus according to claim 12 in which said top includes an integral annular collar about said aperture surrounding said intake conduit, and including means for securing said collar to said intake conduit.

* * * * *